US008931250B2

(12) United States Patent
Morita et al.

(10) Patent No.: US 8,931,250 B2
(45) Date of Patent: Jan. 13, 2015

(54) DRAFT ROLLER, SPINNING UNIT, AND SPINNING MACHINE

(75) Inventors: Akihiro Morita, Kyoto (JP); Sato Goyude, Kyoto (JP)

(73) Assignee: Murata Machinery, Ltd., Kyoto-shi (JP)

( * ) Notice: Subject to any disclaimer, the term of this patent is extended or adjusted under 35 U.S.C. 154(b) by 30 days.

(21) Appl. No.: 13/490,842

(22) Filed: Jun. 7, 2012

(65) Prior Publication Data

US 2013/0000269 A1 Jan. 3, 2013

(30) Foreign Application Priority Data

Jun. 30, 2011 (JP) ..... 2011-146765

(51) Int. Cl.
*D01H 5/74* (2006.01)
*D01H 5/78* (2006.01)

(52) U.S. Cl.
CPC ... *D01H 5/74* (2013.01); *D01H 5/78* (2013.01)
USPC ..... 57/315; 19/258

(58) Field of Classification Search
CPC ..... D01H 5/74; D01H 5/78
USPC ..... 57/315; 19/258; 451/49; 492/27
See application file for complete search history.

(56) References Cited

U.S. PATENT DOCUMENTS

| | | | | | |
|---|---|---|---|---|---|
| 3,212,168 | A * | 10/1965 | Sommer | 19/295 |
| 3,381,350 | A * | 5/1968 | Kemmler | 19/258 |
| 4,313,981 | A * | 2/1982 | Namiki | 427/409 |
| 4,718,225 | A * | 1/1988 | Sanagi | 57/328 |
| 5,420,678 | A * | 5/1995 | Rasch et al. | 399/324 |
| 7,076,840 | B2 * | 7/2006 | Ota | 19/236 |
| 2005/0072136 | A1 | 4/2005 | Ota | |

FOREIGN PATENT DOCUMENTS

| | | |
|---|---|---|
| EP | 2455518 A2 | 5/2012 |
| JP | 4-671 | 1/1992 |
| JP | 06-257023 | 9/1994 |
| JP | 07-126926 | 5/1995 |
| JP | 2005-113274 | 10/2003 |
| JP | 2004-225216 | 8/2004 |
| JP | 2010-163702 | 7/2010 |
| JP | 2012-107363 A | 6/2012 |

* cited by examiner

*Primary Examiner* — Shaun R Hurley
(74) *Attorney, Agent, or Firm* — Adli Law Group P.C.

(57) ABSTRACT

The front top roller (20) includes a fiber contacting portion (30) and a reduced-diameter portion (31). The fiber contacting portion (30) has a substantially uniform outer diameter. The reduced-diameter portion (31) is provided at both ends of the fiber contacting portion (30) in an axial direction, and is formed with an outer diameter smaller than an outer diameter of the fiber contacting portion (30). The fiber contacting portion (30) has a width (W1) in an axial direction of 18 mm and the outer diameter (D1) of 30 mm. An outer diameter (D2) of the reduced-diameter portion (31) is 25 mm.

6 Claims, 13 Drawing Sheets

DRAFT ROLLER, SPINNING UNIT, AND SPINNING MACHINE

CROSS REFERENCE

The present application claims the benefit of JP-2011-146765 filed on Jun. 30, 2011, which is incorporated herein by reference in its entirety.

FIELD OF THE INVENTION

The present invention mainly relates to a shape of a draft roller arranged in a spinning machine.

BACKGROUND OF THE INVENTION

A spinning machine includes a spinning device adapted apply a twist to a fiber bundle to produce a spun yarn. The spinning machine also includes a draft device adapted to draft the fiber bundle (stretch the fiber bundle). The draft device sandwiches the fiber bundle (or the sliver) with a rotating draft roller pair and transports the fiber bundle to stretch the fiber bundle into an appropriate fiber width, and to supply the fiber bundle to the spinning device.

In this type of draft device, the draft roller rotates at high speed, and thus airflow (accompanying airflow) is generated along an outer peripheral surface of the draft roller. This accompanying airflow is known to greatly influence yarn quality. Therefore, conventionally, attempts have been made to devise a shape of the draft roller to reduce an adverse effect by the accompanying airflow. Such a draft roller is described in Japanese Unexamined Patent Publication Nos. 7-126926 (Patent Document 1), 2010-163702 (Patent Document 2), and 2005-113274 (Patent Document 3).

Patent Document 1 discloses a front top roller in which an effective roller width is narrowed to about a half or more of a standard width. In other words, a step is provided on an outer periphery of the front top roller disclosed in Patent Document 1. In Patent Document 1, according to such a configuration, the drafted fiber bundle is not influenced by the accompanying airflow and cotton fly is hardly moved to both sides of the front top roller.

In Patent Document 2, a step formed on a front top roller (referred to as gap L in Patent Document 2) is preferably greater than or equal to 1 mm and smaller than or equal to 3 mm. However, Patent Document 2 does not disclose about other specific dimensions of the step.

In this regard, according to Patent Document 3, in high speed spinning exceeding 300 m/min (experiment was conducted at specifically 350 m/min in Patent Document 3), a dimension of a step of a front roller (referred to as gap B in Patent Document 3) is suitably 1.5 mm. In Patent Document 3, drawbacks occur even if the step of the front roller is too narrow or too wide.

As described above, when forming the step on the front top roller, it is known that the step of 1.5 mm is the most suitable. As pointed out in Patent Document 3, drawbacks occur even if the dimension of the step is too high or too low. Therefore, the dimension of the step of the front top roller is not ventured to be set to other than 1.5 mm.

The front top roller of the draft device is generally made of rubber. With such a rubber roller, a portion that makes contact with the fiber bundle (central portion in an axial direction) tends to wear and become recessed through use. That is, the rubber front top roller is a consumable. However, if the front top roller is discarded with minor wear, an operation cost of the spinning machine increases. Thus, attempts have been made to abrade a surface of the worn-out front top roller into a smooth state (state in which the recess is eliminated) so that the front top roller can be reused.

Meanwhile, since the outer diameter of the front top roller becomes smaller with the abrasion of the surface of the front top roller, the step formed on the front top roller becomes smaller. As a result, yarn quality degrades. Therefore, in view of the quality of the spun yarn to be produced, a minimum diameter of the usable front top roller is set and the reuse of the front top roller, which outer diameter has become smaller than the minimum diameter, needs to be prohibited. Thus, the conventional front top roller cannot be repeatedly abraded and used for a long period of time.

Patent Document 3 assumes a spinning speed of at least 300 m/min as "high speed spinning", but due to further improvement in the spinning speed of recent years, the spinning speed may exceed 400 m/min. Therefore, a rotation speed of the draft roller is becoming higher in recent years than at the time of the application of Patent Document 3, and an influence of the accompanying airflow on the yarn quality is also assumed to have changed. Therefore, the shape of the draft roller assumed as optimum in the above patent documents may not be optimum in the current high speed spinning (spinning speed of around 400 m/min). In other words, there is still room for improvements to improve the shape of the draft roller to enhance the yarn quality.

BRIEF SUMMARY OF THE INVENTION

An object of the present invention is to provide a draft roller in which degradation of yarn quality is reduced.

According to a first aspect of the present invention, a draft roller suitable for drafting a fiber bundle includes a fiber contacting portion and a reduced-diameter portion. The fiber contacting portion has a substantially uniform outer diameter. The reduced-diameter portion is provided at both ends of the fiber contacting portion in an axial direction, and is formed with an outer diameter smaller than the outer diameter of the fiber contacting portion. The fiber contacting portion has a width in an axial direction of 18 mm and the outer diameter of 30 mm. The outer diameter of the reduced-diameter portion is 25 mm.

Since a step formed by the fiber contacting portion and the reduced-diameter portion is 2.5 mm, the draft roller has a margin in the step as compared to the conventional draft roller (step of 1.5 mm). Therefore, even if the fiber contacting portion is abraded and the step becomes small, an influence on the yarn quality is smaller than the conventional draft roller. As a result, since the number of times of abrasion can be increased with the above draft roller than the conventional draft roller, the draft roller can be used for a longer period of time, and an operation cost can be reduced.

In the above draft roller, after abrading the outer peripheral surface of the fiber contacting portion, a step formed by an outer peripheral surface of the fiber contacting portion and an outer peripheral surface of the reduced-diameter portion is preferably at least 1.5 mm.

Since the step is made greater than the conventional draft roller, the draft roller according to an embodiment of the present invention can allow the abrasion of the fiber contacting portion while the step is greater than at least the conventional draft roller (a step of 1.5 mm). If the fiber contacting portion is excessively abraded, a thickness of a rubber of the fiber contacting portion becomes thin and a force of gripping the fiber bundle is lowered, which may cause the degradation in the yarn quality. However, according to the structure described above, the step of at least 1.5 mm can be ensured. Therefore, the yarn quality can be maintained.

According to a second aspect of the present invention, a draft roller suitable for drafting a fiber bundle includes a fiber contacting portion and a reduced-diameter portion. The fiber contacting portion has a substantially uniform outer diameter. The reduced-diameter portion is provided at both ends of the fiber contacting portion in an axial direction, and is formed with an outer diameter smaller than the outer diameter of the fiber contacting portion. A step of at least 1.5 mm is formed by an outer peripheral surface of the fiber contacting portion and an outer peripheral surface of the reduced-diameter portion after abrasion of the outer peripheral surface of the fiber contacting portion.

Since the above draft roller has a larger margin in abrading the fiber contacting portion than the conventional draft roller (a step of 1.5 mm), the number of times of abrasion of the fiber contacting portion can be increased. Accordingly, the draft roller can be used for a longer period of time, and the operation cost can be reduced.

The draft roller is structured such that the outer diameter of the reduced-diameter portion is 25 mm, and the outer diameter before the abrasion of the fiber contacting portion is 30 mm.

Since the step formed by the fiber contacting portion and the reduced-diameter portion is 2.5 mm, the draft roller has a margin in the step as compared to the conventional draft roller (a step of 1.5 mm). Therefore, even if the fiber contacting portion is abraded and the step becomes small, the influence on the yarn quality is smaller than the conventional draft roller. As a result, since the above draft roller can be abraded more times than the conventional draft roller, the draft roller can be used for a longer period of time, and the operation cost can be reduced.

In the above draft roller, the fiber contacting portion and the reduced-diameter portion are preferably connected by a taper portion.

According to such a structure, when abrading the outer peripheral surface of the fiber contacting portion with a grinding machine, the draft roller can be more easily brought close to a grinding stone from the axial direction, and an abrasion operation can be smoothly carried out.

According to a third aspect of the present invention, a spinning unit includes a draft device adapted to draft a fiber bundle, and a spinning section adapted to spin a fiber bundle drafted by the draft device at a spinning speed of at least 400 m/min. The draft device includes a draft roller adapted to draft the fiber bundle by rotating. The draft roller includes a fiber contacting portion and a reduced-diameter portion. The fiber contacting portion has a substantially uniform diameter. The reduced-diameter portion is provided at both ends of the fiber contacting portion in an axial direction, and is formed with an outer diameter smaller than the outer diameter of the fiber contacting portion. A step of 2.5 mm is formed by an outer peripheral surface of the fiber contacting portion and an outer peripheral surface of the reduced-diameter portion.

Since the step of 2.5 mm is formed as described above, there is a margin in the step as compared to the conventional draft roller (a step of 1.5 mm). Therefore, even if the fiber contacting portion is abraded and the step becomes small, the influence on the yarn quality is smaller than the conventional draft roller. As a result, since the above draft roller can be abraded more times than the conventional draft roller, the draft roller can be used for a longer period of time, and the operation cost can be reduced. Furthermore, in the draft roller having the step of 2.5 mm as described above, the number of yarn defects can be reduced compared to the conventional draft roller in the high speed spinning in which the spinning speed is at least 400 m/min.

In the above spinning unit, the fiber contacting portion preferably has a width in an axial direction of 18 mm and an outer diameter of 30 mm, and the reduced-diameter portion preferably has an outer diameter of 25 mm.

In the draft roller arranged in the spinning unit, the number of yarn defects can be reduced as compared to the conventional draft roller, particularly in the high speed spinning in which the spinning speed is at least 400 m/min.

In the above spinning unit, the draft device includes a plurality of rollers adapted to draft the fiber bundle and arranged along a transportation direction of the fiber bundle. The draft roller is a front top roller arranged most downstream in the transportation direction in the draft device.

In the draft device, the rotation speed of the roller becomes higher at the downstream. Therefore, since the front top roller arranged most downstream rotates at a very high speed, the influence of the accompanying airflow is large and wear is also severe. Accordingly, the structure of the draft roller described above is applied to the front top roller so that an effect of increasing the number of times of abrasion as well as reducing the number of yarn defects can be suitably achieved.

According to a fourth aspect of the present invention, a spinning machine including a plurality of spinning units described above is provided.

In such a spinning machine, since the draft roller having a usable period longer than the conventional draft roller is adopted in each spinning unit, the operation cost of the entire spinning machine can be reduced. In the high speed spinning of at least 400 m/min, by adopting the draft roller having a step (step of 2.5 mm) greater than the conventional draft roller in each spinning unit, the influence of the accompanying airflow is less likely to be received, and consequently, a variation in yarn quality for each spinning unit can be reduced and the quality of the produced spun yarn can be maintained uniform.

According to a fifth aspect of the present invention, there is provided a spun yarn manufacturing method for manufacturing a spun yarn by applying a twist to a fiber bundle drafted by a draft roller. The draft roller includes a fiber contacting portion and a reduced-diameter portion. The fiber contacting portion has a substantially uniform outer diameter. The reduced-diameter portion is provided at both ends of the fiber contacting portion in an axial direction and is formed with an outer diameter smaller than the outer diameter of the fiber contacting portion. Spinning is performed while gradually changing a step formed by an outer peripheral surface of the fiber contacting portion and an outer peripheral surface of the reduced-diameter portion from 2.5 mm to 1.5 mm.

If the outer peripheral surface of the fiber contacting portion begins to be recessed by wear, the outer peripheral surface of the fiber contacting portion is abraded to reduce the outer diameter, so that the outer peripheral surface of the fiber contacting portion is in a smooth state and the draft roller can be reused. Although the step of the outer peripheral surface of the roller is gradually reduced through such abrasion, the yarn quality can be prevented from degrading by having the step within the range described above.

DETAILED DESCRIPTION OF PREFERRED EMBODIMENTS

Figure 1:
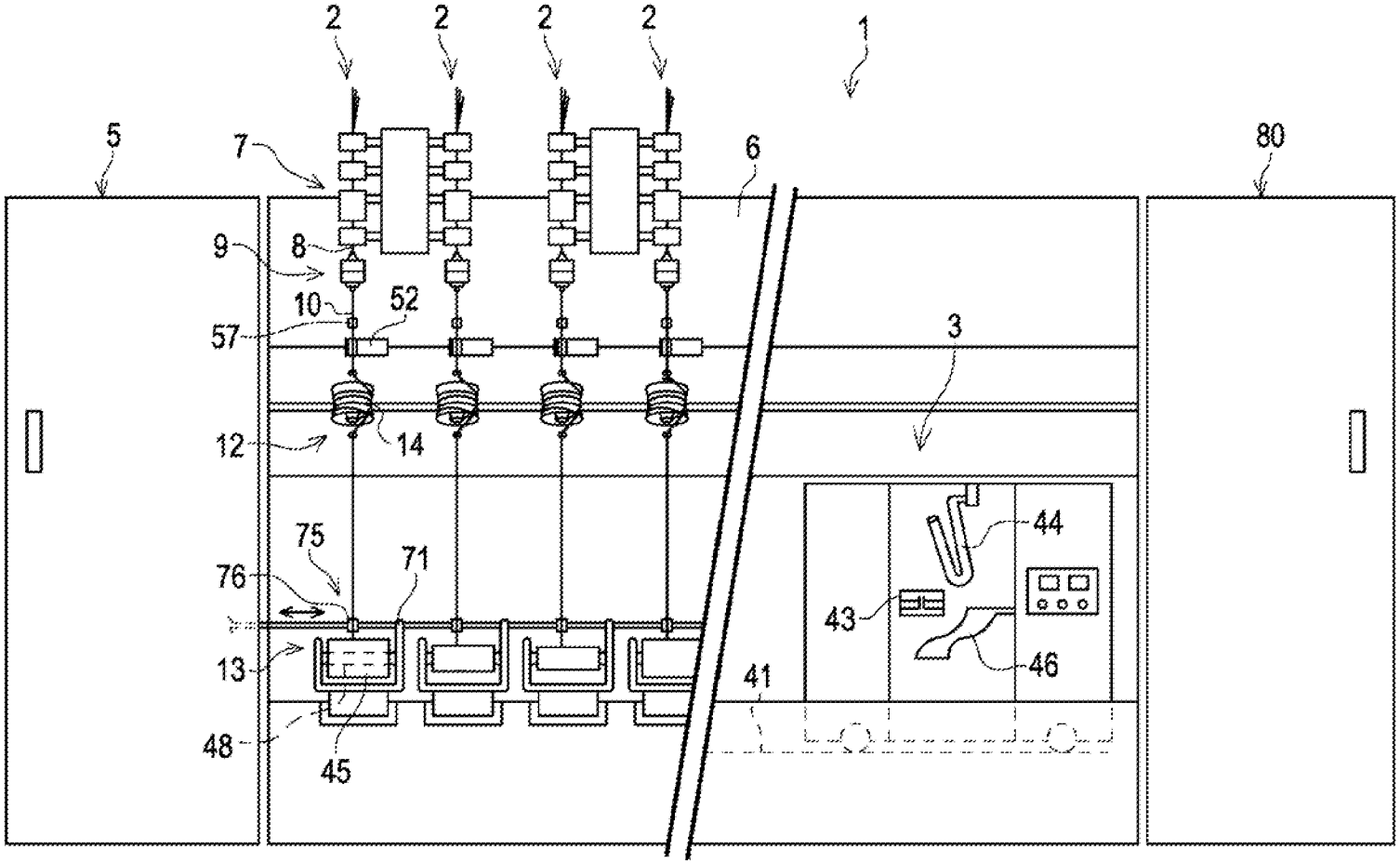
FIG. 1 is a front view illustrating an overall structure of a fine spinning machine according to one embodiment of the present invention.

A fine spinning machine (spinning machine) according to one embodiment of the present invention will be described with reference to the drawings. A fine spinning machine 1 as a spinning machine illustrated in FIG. 1 includes a plurality of spinning units 2 arranged in line, a yarn joining cart 3, a blower box 80, and a motor box 5.

As illustrated in FIG. 1, each spinning unit 2 includes a draft device 7, a spinning device (spinning section) 9, a yarn accumulating device 12, and a winding device 13, arranged in this order from upstream to downstream. "Upstream" and "downstream" respectively refer to upstream and downstream in a travelling direction of a fiber bundle and a yarn at the time of spinning. Each spinning unit 2 is adapted to spin a fiber bundle 8 fed from the draft device 7 by the spinning device 9 to produce a spun yarn 10, and the spun yarn 10 is wound by the winding device 13 into a package 45. Each spinning unit 2 is set so as to produce the spun yarn 10 at a spinning speed of at least 400 m/min.

The draft device 7 is arranged in proximity to an upper end of a housing 6 of the fine spinning machine 1. The draft device 7 drafts (stretches the fibers) of a sliver (material of the fiber bundle) 15 supplied from a sliver case (not illustrated) through a sliver guide (not illustrated) until a predetermined width is obtained.

The draft device 7 includes a plurality of draft rollers. Two draft rollers as one set form a draft roller pair. The draft device 7 of the present embodiment is a so-called four line draft device including four draft roller pairs, i.e., a back roller pair including draft rollers 16 and 66, a third roller pair including draft rollers 17 and 67, a middle roller pair including draft rollers 19 and 69, and a front roller pair including draft rollers 20 and 70, arranged in this order from the upstream.

In each draft roller pair, a draft roller on a front side of the fine spinning machine 1 is referred to as a top roller, and a draft roller on a rear side of the fine spinning machine 1 is referred to as a bottom roller. The top rollers are, in the order from the upstream, a back top roller 16, a third top roller 17, a middle top roller 19 provided with an apron belt 18 made of rubber, and a front top roller 20. The bottom rollers are, in the order from the upstream, a back bottom roller 66, a third bottom roller 67, a middle bottom roller 69 provided with an apron belt 68 made of rubber, and a front bottom roller 70.

Outer peripheral surfaces of the top rollers 16, 17, and 20 are made of rubber. Since the outer peripheral surface of the top roller is made of rubber, the outer peripheral surface of the top roller can be caused to elastically make contact with the sliver 15, and each draft roller pair can firmly sandwich the sliver 15. Each top roller 16, 17, 19, 20 is supported via a bearing (not illustrated) and the like in a freely rotatable manner with an axis line thereof as a center.

Each bottom roller 66, 67, 69, 70 is a roller made of metal, and is rotatably driven with an axis line thereof as the center by a driving source Mot illustrated). In each draft roller pair, the top roller and the bottom roller are arranged to face each other. The draft device 7 includes an urging unit (not illustrated) adapted to urge each of the top rollers 16, 17, 19, and 20 towards the opposing bottom rollers 66, 67, 69, and 70, respectively. The outer peripheral surface of the top roller 16, 17, 19, and 20 is thereby pushed against the outer peripheral surface of the bottom roller 66, 67, 69, and 70, respectively. When the bottom rollers 66, 67, 69, and 70 are rotatably driven, the top rollers 16, 17, 19, and 20 opposing and contacting thereto also rotate accompanying the rotation of the bottom rollers 66, 67, 69, and 70.

The draft device 7 sandwiches the sliver 15 between the rotating top rollers 16, 17, 19, and 20 and the bottom rollers 66, 67, 69, and 70, and transports the sliver 15 towards the downstream. The draft device 7 is structured such that the rotation speed becomes faster towards the draft roller pair on the downstream. Therefore, the fiber bundle 8 (or the sliver 15) is stretched (drafted) while being transported between the draft roller pair and the draft roller pair. A degree to which the fiber bundle 8 is drafted can be changed by appropriately setting the rotation speed of each of the bottom rollers 66, 67, 69, and 70, and thus the fiber bundle 8 can be drafted into a desired fiber width.

The spinning device 9 is arranged immediately downstream of the front roller pair. The fiber bundle 8 drafted by the draft device 7 is supplied to the spinning device 9. By supplying the fiber bundle 8 drafted to a predetermined width to the spinning device 9, the spun yarn 10 of a desired yarn count (thickness) can be spun by the spinning device 9.

Figure 3:
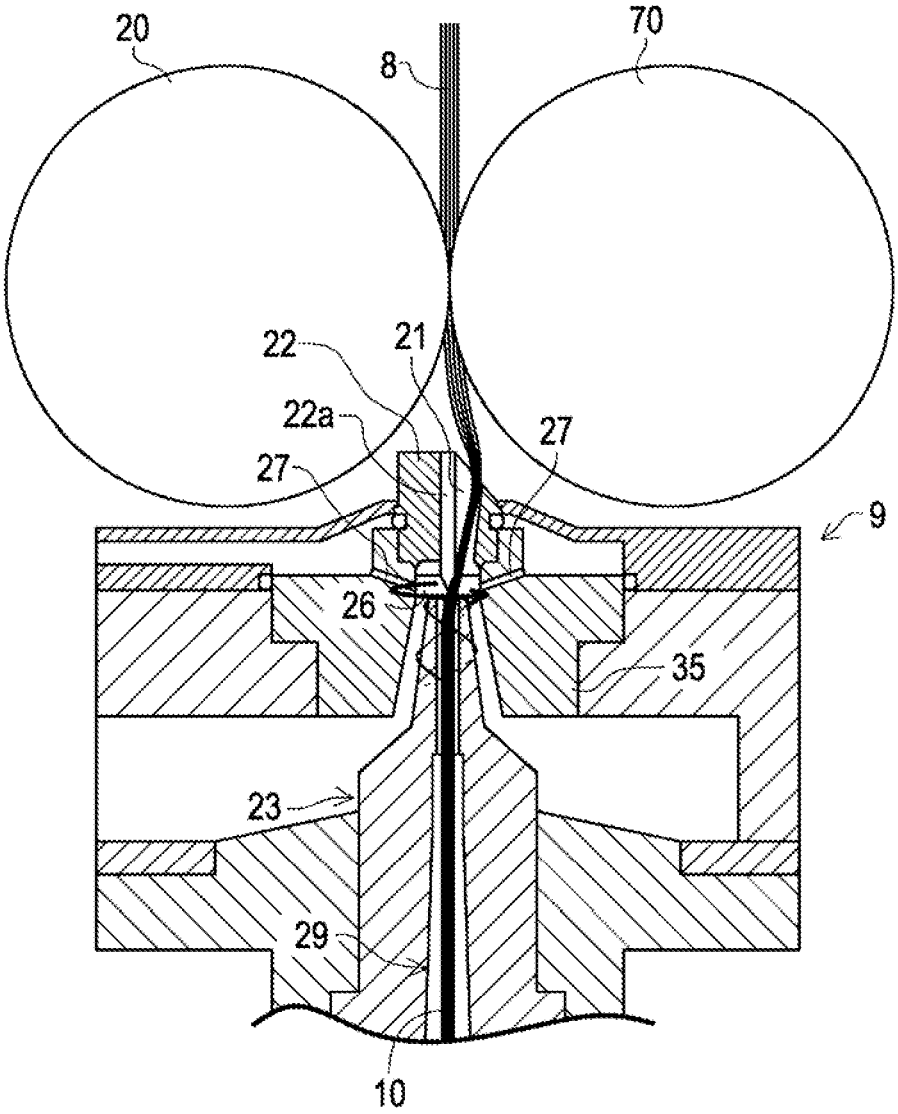
FIG. 3 is a cross-sectional view of a spinning device.

The spinning device 9 applies a twist to the fiber bundle 8 supplied from the draft device 7 to produce the spun yarn 10. In the present embodiment, an air-jet spinning device which uses whirling airflow to apply the twist to the fiber bundle B is adopted. This type of spinning device can also perform high speed spinning of at least 400 m/min. As illustrated in FIG. 3, the spinning device 9 mainly includes a nozzle holder 35, a hollow guide shaft body 23, and a fiber guide (fiber guiding section) 22.

A spinning chamber 26 is formed between the nozzle holder 35 and the hollow guide shaft body 23. The nozzle holder 35 is provided with an air ejecting nozzle 27 for ejecting air into the spinning chamber 26. The fiber guide 22 is provided with a yarn introducing port 21 for introducing the fiber bundle 8 into the spinning chamber 26. The air ejecting nozzle 27 is configured to eject the air into the spinning chamber 26 to generate whirling airflow. The fiber bundle 8 supplied from the draft device 7 is guided into the spinning chamber 26 by the fiber guide 22 having the yarn introducing port 21. In the spinning chamber 26, the fiber bundle 8 is swung around the periphery of the hollow guide shaft body 23 by the whirling airflow, and the twist is applied to produce the spun yarn 10. The twisted spun yarn 10 is passed through a yarn passage 29 formed at an axial center of the hollow guide shaft body 23, and fed to an outside of the spinning device 9 from a yarn exit (not illustrated) on the downstream of the hollow guide shaft body 23.

A needle-like guide needle 22*a* is arranged in the yarn introducing port 21, and a tip of the guide needle 22*a* is arranged towards the spinning chamber 26. The fiber bundle 8 introduced from the yarn introducing port 21 is guided into the spinning chamber 26 so as to be wound around the guide needle 22*a*. Accordingly, a state of the fiber bundle 8 introduced into the spinning chamber 26 can be stabilized. Furthermore, since the fiber bundle 8 is guided so as to be wound around the guide needle 22*a*, even if a twist is applied to the fiber in the spinning chamber 26, the twist is prevented from being propagated to the upstream of the fiber guide 22. Accordingly, the twist applied by the spinning device 9 is prevented from influencing the draft device 7. However, the guide needle 22*a* may be omitted, and a downstream end of the fiber guide 22 may function as the guide needle 22*a*.

The winding device 13 is arranged downstream of the spinning device 9. The winding device 13 includes a cradle arm 71 supported to be swingable about a supporting shaft 73. The cradle arm 71 can rotatably support a bobbin 48 for winding the spun yarn 10.

The winding device 13 includes a winding drum 72 and a traverse device 75. The winding drum 72 is adapted to be driven while making contact with an outer peripheral surface of the bobbin 48 or an outer peripheral surface of the package 45 formed by winding the spun yarn 10 around the bobbin 98. The traverse device 75 includes a traverse guide 76 capable of engaging the spun yarn 10. The winding drum 72 is driven by an electric motor (not illustrated) while reciprocating the traverse guide 76 by a driving unit (not illustrated). The package 45 making contact with the winding drum 72 can be rotated, and the spun yarn 10 can be wound into the package 45 while being traversed.

Figure 2:
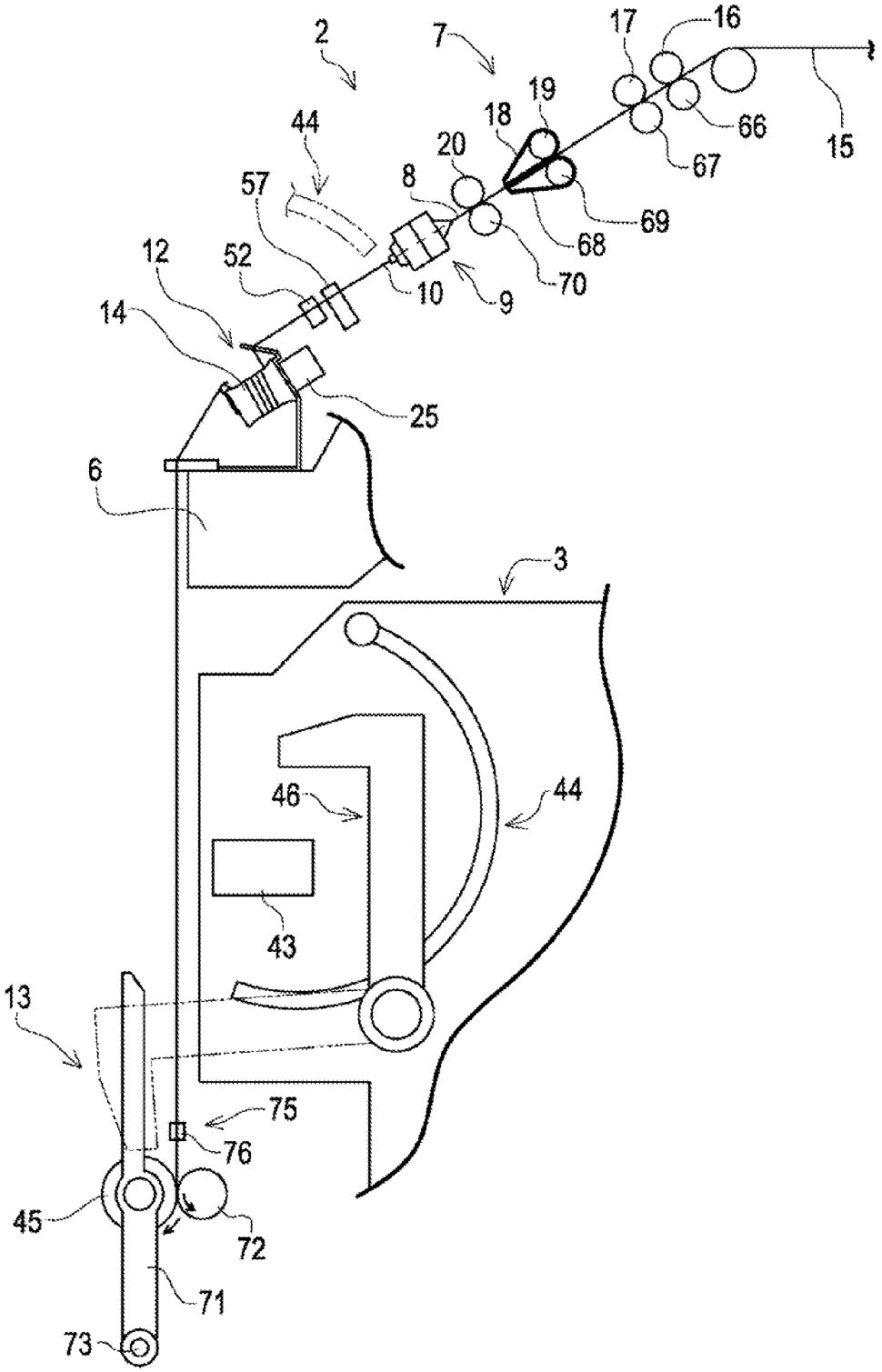
FIG. 2 is a schematic side view of a spinning unit.

As illustrated in FIG. 1 and FIG. 2, the yarn joining cart 3 includes a splicer (yarn joining device) 43, a suction pipe 44, and a suction mouth 46. When yarn breakage or yarn cut occurs in a spinning unit 2, the yarn joining cart 3 travels on a rail 41 to the relevant spinning unit 2 and stops. The suction pipe 44 sucks and catches a yarn end fed from the spinning device 9 while being swung vertically with a shaft as the center and guides the yarn end to the splicer 43. The suction mouth 46 sucks and catches a yarn end from the package 45 supported by the winding device 13 while being swung vertically with a shaft as the center and guides the yarn end to the splicer 43. The splicer 43 joins the guided yarn ends.

The yarn accumulating device 12 is arranged between the spinning device 9 and the winding device 13. As illustrated in FIG. 2, the yarn accumulating device 12 includes a yarn accumulating roller 14, and an electric motor 25 for rotatably driving the yarn accumulating roller 19.

The yarn accumulating roller 14 can have a prescribed amount of the spun yarn 10 wound around an outer peripheral surface thereof to temporarily accumulate the spun yarn 10. The yarn accumulating device 12 rotates the yarn accumulating roller 14 at a predetermined rotation speed with the spun yarn 10 wound around the outer peripheral surface of the yarn accumulating roller 14 to pull out the spun yarn 10 from the spinning device 9 at a predetermined speed and transport the spun yarn 10 towards the downstream. Since the spun yarn 10 is temporarily accumulated on the outer peripheral surface of the yarn accumulating roller 14, the yarn accumulating device 12 can function as one type of buffer. Accordingly, a drawback (e.g., slackening of the spun yarn 10 or the like) when a spinning speed in the spinning device 9 and a winding speed in the winding device 13 do not match for some reason can be resolved.

A yarn clearer (yarn quality measuring instrument) 52 is arranged at a position between the spinning device 9 and the yarn accumulating device 12. The spun yarn 10 spun by the spinning device 9 is passed through the yarn clearer 52 before being wound by the yarn accumulating device 12. The yarn clearer 52 monitors the travelling spun yarn 10 with a capacitance sensor (not illustrated), and when a yarn defect of the spun yarn 10 (area where abnormality is found in thickness or the like of the spun yarn 10) is detected, the yarn clearer 52 transmits a yarn defect detection signal to a unit controller (not illustrated). The yarn clearer 52 may perform monitoring with an optical sensor instead of a capacitance sensor.

Upon receiving the yarn defect detection signal, the unit controller immediately cuts the spun yarn 10 with a cutter 57, stops the draft device 7, the spinning device 9, and the like, and also stops the winding in the winding device 13. The unit controller transmits a control signal to the yarn joining cart 3 to cause the yarn joining cart 3 to travel to front of the relevant spinning unit 2. The yarn joining cart 3 guides the yarn end from the spinning device 9 and the yarn end from the package 45 to the splicer 43 with the suction pipe 44 and the suction mouth 46, respectively, and carries out a yarn joining operation by the splicer 43. According to such a yarn joining operation, the yarn defect is removed, and the winding of the spun yarn 10 into the package 45 can be resumed. The cutter 57 may be omitted, and the spun yarn 10 may be cut as if being torn off by stopping the driving of the draft device 7 while continuing the driving of the winding device 13.

The front top roller 20 arranged in the draft device 7 will be described in detail below.

As described above, since the rotation speed becomes faster for the draft roller pair located downstream in the draft device 7, the rotation speed of the front roller pair which is the draft roller pair arranged most downstream (the front top roller 20 and the front bottom roller 70) becomes very fast. Thus, the accompanying airflow generated in proximity to the front roller pair also becomes very strong, and an influence of the accompanying airflow on the yarn quality also becomes large. In the draft device 7 according to the present embodiment, in order to reduce the influence of the accompanying airflow generated in proximity to the front roller pair rotating at high speed, a step is formed on the outer peripheral surface of the front top roller 20.

Figure 4:
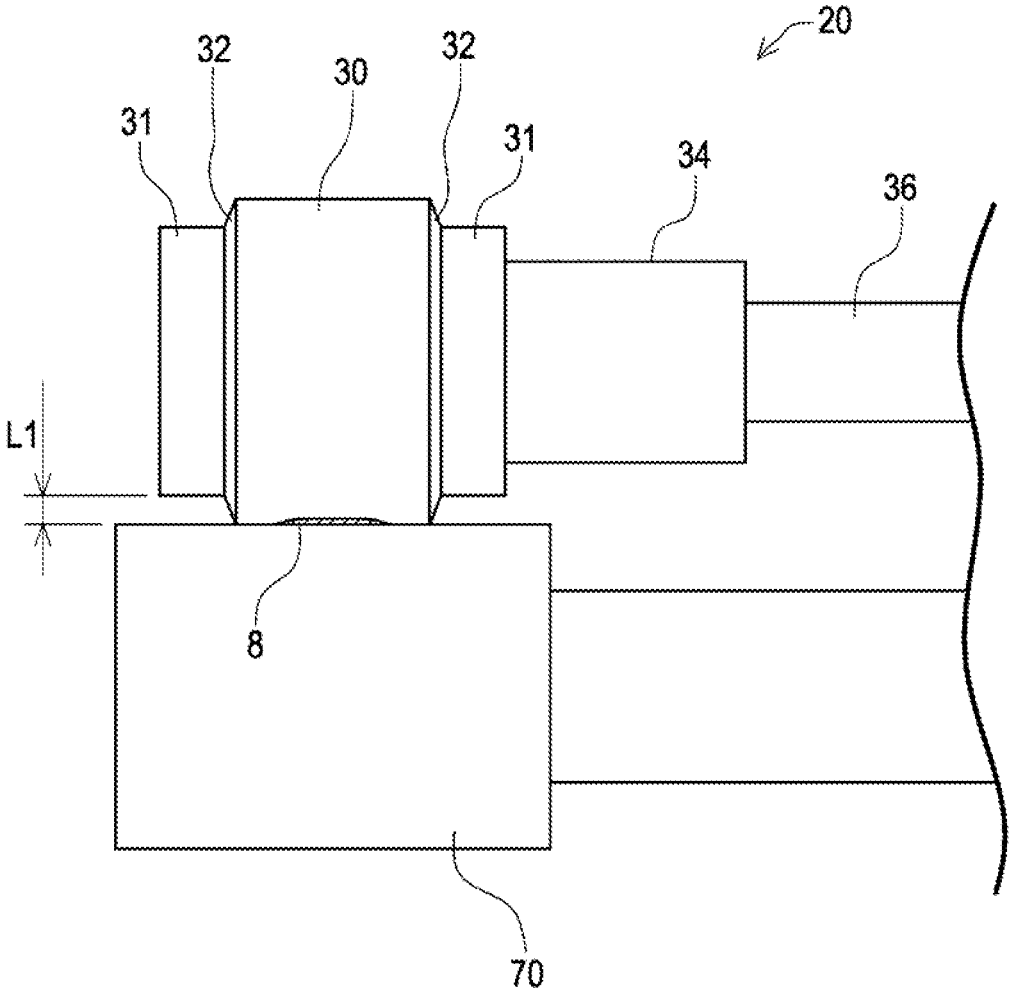
FIG. 4 is a front view of a front roller pair.
Figure 5:
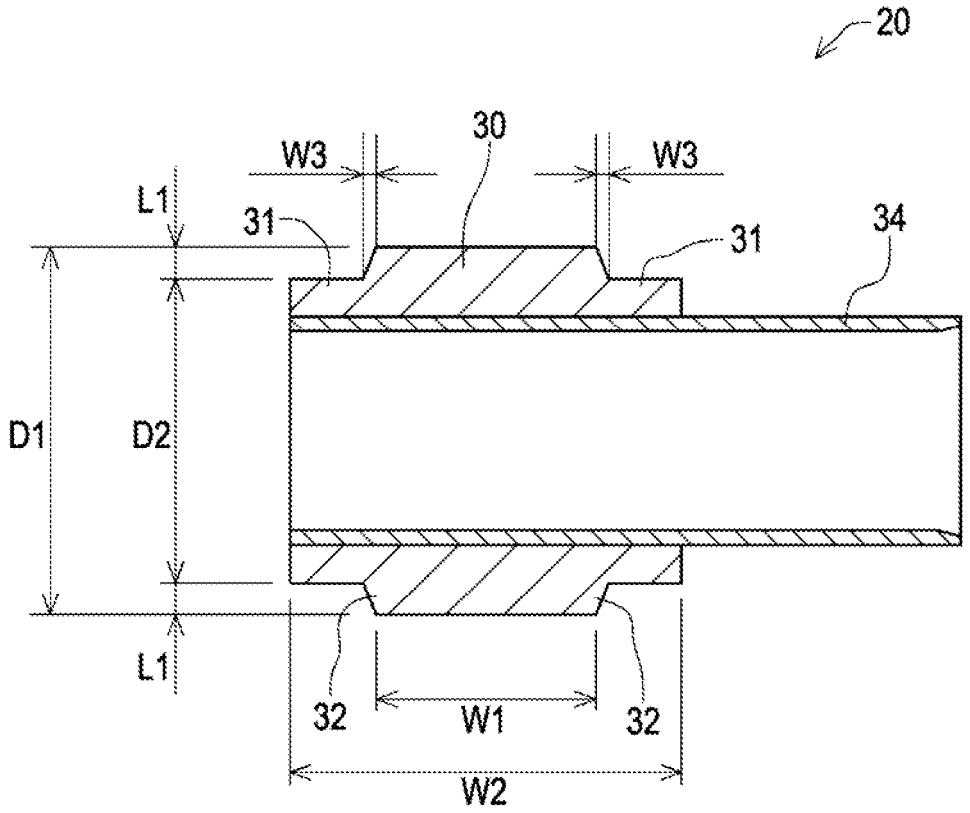
FIG. 5 is a cross-sectional view of a front top roller.

Specifically, as illustrated in FIG. 4 and FIG. 5, the front top roller 20 includes a fiber contacting portion 30 formed in a circular column shape having a substantially uniform outer diameter, and a reduced-diameter portion 31 formed in a circular column shape having an outer diameter smaller than the fiber contacting portion 30 at both ends of the fiber contacting portion 30 in an axial direction. A taper portion 32 is formed between the fiber contacting portion 30 and the reduced-diameter portion 31. As described above, since the front top roller 20 includes the fiber contacting portion 30 and the reduced-diameter portion 31 having an outer diameter smaller than the fiber contacting portion 30, the front top roller 20 have a step formed by an outer peripheral surface of the fiber contacting portion 30 and an outer peripheral surface of the reduced-diameter portion 31 (indicated with reference numeral L1 in FIG. 4 and FIG. 5).

The outer peripheral surface of the fiber contacting portion 30 of the front top roller 20 makes contact with the outer peripheral surface of the front bottom roller 70 arranged facing the front top roller 20. Accordingly, as illustrated in FIG. 4, the front roller pair can sandwich the fiber bundle 8 between the fiber contacting portion 30 and the front bottom roller 70. A gap is formed between the reduced-diameter portion 31 and the front bottom roller 70.

Figure 6:
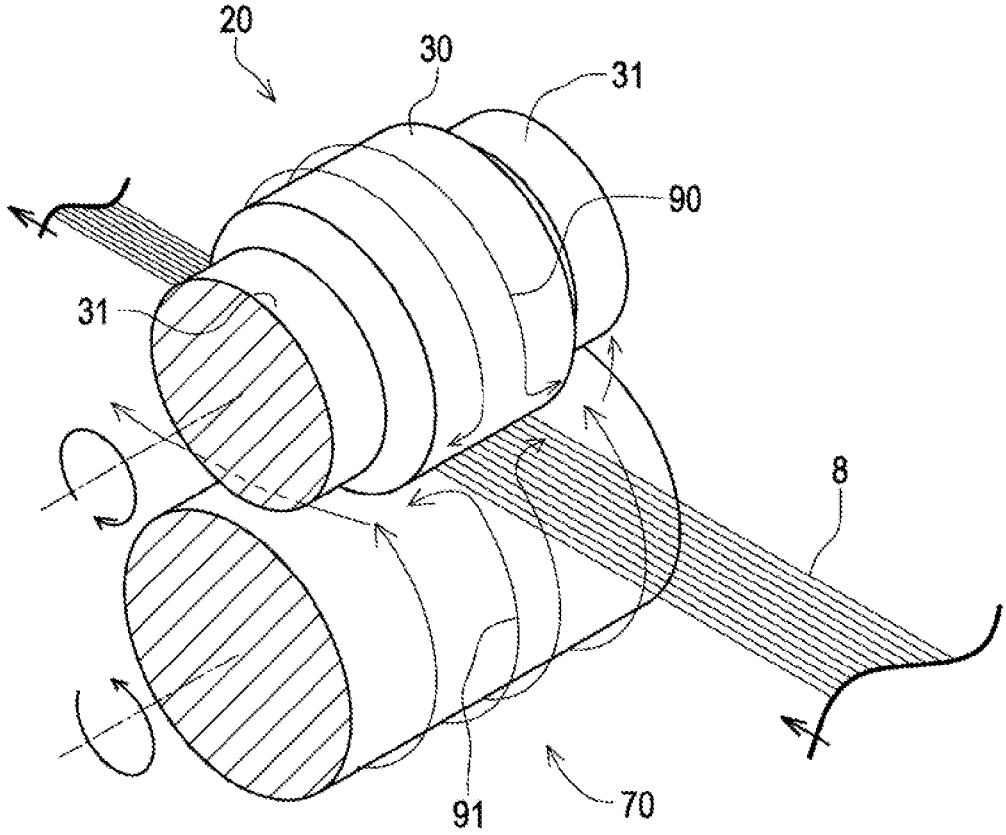
FIG. 6 is a perspective view describing accompanying airflow.

Next, a description will be made on the accompanying airflow generated in proximity to the front top roller 20. As described above, when the front bottom roller 70 facing the front top roller 20 is rotatably driven, the front top roller 20 rotates accompanying the rotation of the front bottom roller 70. Therefore, the front top roller 20 and the front bottom roller 70 rotate in opposite directions to each other. Thus, as illustrated in FIG. 6, accompanying airflow 90 generated by the rotation of the front top roller 20 and accompanying airflow 91 generated by the rotation of the front bottom roller 70 become airflows opposing each other, and collide near an entrance to the front roller pair of the fiber bundle 8.

The collided accompanying airflows 90 and 91 become airflows flowing in a direction parallel to a roller shaft of the front top roller 20 and the front bottom roller 70 (hereinafter simply referred to as axial direction), and flow towards the ends of the front top roller 20 and the front bottom roller 70 in the axial direction (i.e., flow so as to spread outward). When reaching the end of the fiber contacting portion 30 in the axial direction, the accompanying airflow passes through the gap formed between the reduced-diameter portion 31 and the front bottom roller 70 and flows in a direction parallel to the travelling direction of the fiber bundle 8. In this manner, the flow of the accompanying airflow flowing in the axial direction can be released through the gap formed between the reduced-diameter portion 31 and the front bottom roller 70.

As described above, by forming the step L1 on the outer peripheral surface of the front top roller 20, the gap can be formed between the front top roller 20 and the front bottom roller 70, and the accompanying airflow generated by the rotation of the front top roller 20 can be released. As a result, since the flow of the accompanying airflow flowing in the axial direction weakens, the fibers of the fiber bundle 8 can be suppressed from spreading in the axial direction by the accompanying airflow, and the yarn quality can be prevented from being degraded.

In the present embodiment, the step L1 of the front top roller 20 is formed by scraping a normal cylindrical rubber roller. The fiber contacting portion 30, the reduced-diameter portion 31, and the taper portion 32 are formed as an integrated rubber member. However, the entire front top roller 20 is not required to be made of rubber, and only the outer peripheral surface is required to be made of rubber. For example, in the present embodiment, as illustrated in FIG. 5, a metal tubular body 34 is arranged on an inner side of the front top roller 20. Accordingly, rigidity of the front top roller 20 can be ensured. The front top roller 20 according to the present embodiment is provided with a bearing (not illustrated) between the metal tubular body 34 and a rotation shaft 36, and the front top roller 20 can be supported in a freely rotatable manner with respect to the rotation shaft 36.

Next, a description will be made on the wear and abrasion of the front top roller 20.

As described above, since the outer peripheral surface of the front top roller 20 is made of rubber, the front top roller 20 wears with use and the shape changes. In the following description, in order to distinguish from the worn-out front top roller 20, a state before wear (and abrasion) (i.e., shape of the new front top roller 20) is referred to as "initial state".

The wear of the front top roller 20 will be more specifically described below. If the front top roller 20 is continuously used, the outer peripheral surface of the fiber contacting portion 30 making contact with the fibers starts to wear. The outer peripheral surface of the fiber contacting portion 30 is not uniformly in contact with the fiber bundle 8, and the central portion in the axial direction of the fiber contacting portion 30 is mainly in contact with the fiber bundle 8. Therefore, if the front top roller 20 is continuously used, an axial central part of the fiber contacting portion 30 wears and is recessed. If the axial central part of the fiber contacting portion 30 is recessed, a gripping force of the fiber bundle 8 weakens between the outer peripheral surface of the fiber contacting portion 30 and the outer peripheral surface of the front bottom roller 70, which becomes a cause of degradation in the yarn quality.

Figure 7:
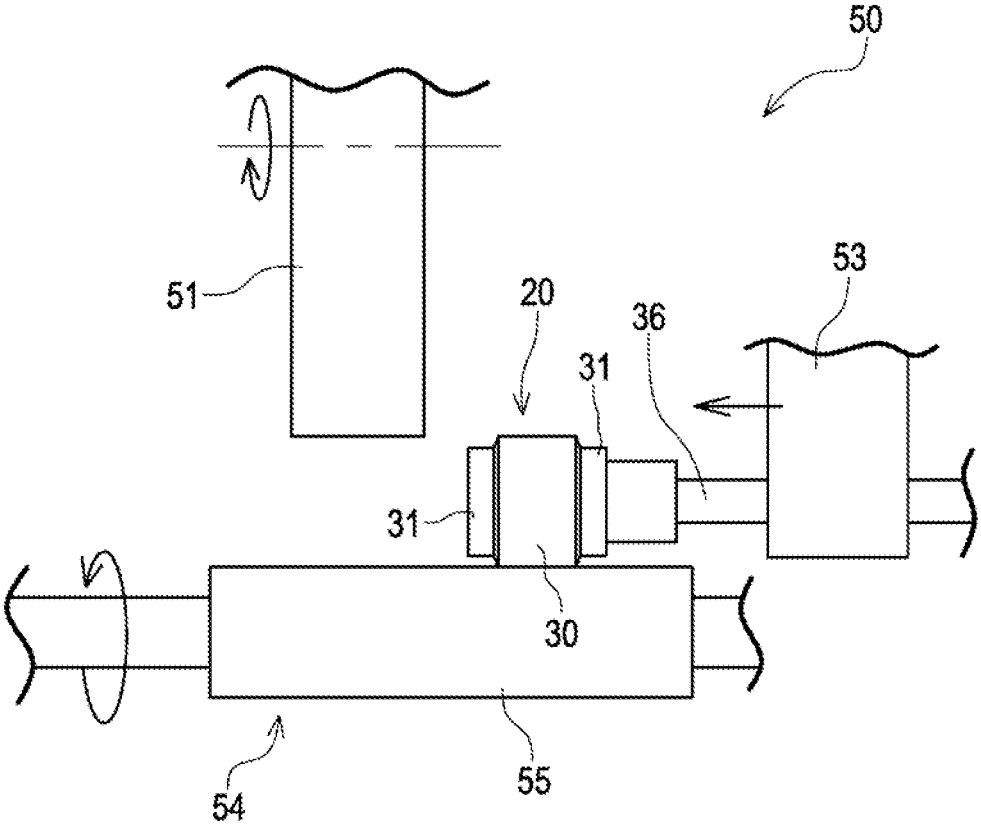
FIG. 7 is a schematic view of an abrasion device.

Therefore, conventionally, the outer peripheral surface of the worn-out front top roller 20 is abraded to a smooth state (state in which the recess is eliminated) so that the front top roller 20 can be reused. An abrasion device 50 therefor is illustrated in FIG. 7.

The abrasion device 50 is configured as one type of grinding machine. Specifically, the abrasion device 50 includes a rotating grinding stone 51, a roller holding section 53, and a roller driving section 54. The roller holding section 53 holds the rotation shaft 36 of the front top roller 20. The roller holding section 53 can move in a direction parallel to an axial direction of the front top roller 20. The roller driving section 54 includes a driving roller 55 which makes contact with the outer peripheral surface of the front top roller 20. The driving roller 55 is rotatably driven by a motor (not illustrated). When the driving roller 55 is rotatably driven, the front top roller 20 making contact with the driving roller 55 can be rotated.

In the abrasion device 50, the roller holding section 53 gripping the rotation shaft 36 of the front top roller 20 is moved towards the grinding stone 51 rotating at high speed from an axial direction of the rotation shaft 36. In this manner, the fiber contacting portion 30 of the front top roller 20 is caused to make contact with the grinding stone 51, and the outer peripheral surface of the fiber contacting portion 30 is abraded. When the driving roller 55 is rotatably driven, the front top roller 20 is rotated about the rotation shaft 36, and the outer peripheral surface of the fiber contacting portion 30 can be uniformly abraded.

Since the taper portion 32 is formed on the front top roller 20 of the present embodiment, the fiber contacting portion 30 can be caused to smoothly make contact with the grinding stone 51. If the taper portion 32 is not formed (when cross-sectional contour of a connecting portion of the fiber contacting portion 30 and the reduced-diameter portion 31 is a right angle), the grinding stone 51 may get caught at the step of the front top roller 20 when the front top roller 20 is moved towards the grinding stone 51, and the abrasion may not be smoothly carried out. Since the taper portion 32 is formed between the fiber contacting portion 30 and the reduced-diameter portion 31, the front top roller 20 of the present embodiment can cause the fiber contacting portion 30 to smoothly make contact with the grinding stone 51.

Problems that may arise from the abrasion will be briefly described below.

As described above, the conventional front top roller typically has a dimension of the step of 1.5 mm. Patent Document 3 describes that defects arise if the step is smaller than 1.5 mm. If the fiber contacting portion of the conventional front top roller (step of 1.5 mm) is abraded, it is apparent that the step becomes smaller than 1.5 mm. In other words, the yarn quality degrades as more abrasion is carried out in the conventional front top roller (step of 1.5 mm). Thus, in the conventional front top roller, the number of times the abrasion can be carried out for reuse is small, and consequently, life of the front top roller is short.

A reason why the yarn quality degrades as the step becomes smaller will be described below. If the step L1 becomes small, the gap formed between the front top roller 20 and the front bottom roller 70 becomes narrow, and the effect of releasing the accompanying airflow through the gap weakens. As a result, the fibers are easily disturbed by the accompanying airflow, which may degrade the yarn quality. Reduction in the step L1 means that a thickness of the rubber at a portion of the fiber contacting portion 30 is reduced. Therefore, the force of gripping the fiber bundle 8 with the fiber contacting portion 30 and the front bottom roller 70 weakens and the yarn quality degrades.

A shape of each section of the front top roller 20 of the present embodiment will be specifically described below.

The front top roller 20 of the present embodiment is structured as below in view of the problems of the conventional front top roller having a step of 1.5 mm. The front top roller 20 has a step L1 of 2.5 mm in the initial state. Since the step of the initial state is greater than the conventional front top roller (step of 1.5 mm), a margin for abrading the outer peripheral surface of the front top roller 20 can be provided, and the life of the front top roller 20 can be lengthened.

Specifically, in the initial state, the fiber contacting portion 30 of the front top roller 20 according to the present embodiment has a width W1 of 18 mm, and an outer diameter D1 of 30 mm. A width W2 of the reduced-diameter portion 31 is 6 mm, on each left and right side, and an outer diameter D2 is 25 mm. That is, a difference (D1-D2) between the outer diameter D1 of the fiber contacting portion 30 and the outer diameter D2 of the reduced-diameter portion 31 is 5 mm in the initial state. Therefore, the step L1 formed by the outer peripheral surface of the fiber contacting portion 30 and the outer peripheral surface of the reduced-diameter portion 31 is 2.5 mm in the initial state. A width W3 of the taper portion 32 in the axial direction is 1 mm on each end of the fiber contacting portion 30.

Therefore, with the step L1 of the front top roller 20 as 2.5 mm in the initial state, the margin for scraping the outer peripheral surface of the fiber contacting portion 30 can be ensured 1 mm more than the conventional front top roller (a step of 1.5 mm). This is because even if the outer peripheral surface of the fiber contacting portion 30 of the front top roller 20 of the present embodiment is scraped by 1 mm (even if the outer diameter D1 of the fiber contacting portion 30 is reduced by 2 mm), the step of 1.5 mm, which is the same as the conventional front top roller, can be ensured. In other words, if the step L1 after the outer peripheral surface of the fiber contacting portion 30 is abraded is greater than or equal to 1.5 mm, the front top roller 20 of the present embodiment can be continuously used. The use of the front top roller 20 may, of course, be continued even if the step L1 after the abrasion becomes smaller than 1.5 mm, but this is not recommended since the quality of the spun yarn 10 may degrade.

Therefore, the manufacturing method of the spun yarn 10 by the fine spinning machine 1 of the present embodiment is as described below.

First, an operator of the fine spinning machine 1 attaches the (new) front top roller 20 in the initial state to the spinning unit 2. At this time, the step L1 of the front top roller 20 is 2.5 mm. Under this state, the spun yarn 10 is produced at the spinning speed of at least 400 m/min. As the spinning is continued, the fiber contacting portion 30 wears and is recessed. After the fiber contacting portion 30 is worn out to a certain degree, the operator once detaches the worn-out front top roller 20 from the spinning unit 2 and abrades the outer peripheral surface of the fiber contacting portion 30 with the abrasion device 50. Accordingly, the outer diameter D1 of the fiber contacting portion 30 is reduced, and the step L1 becomes smaller.

If the step L1 of the front top roller 20 after the abrasion is greater than or equal to 1.5 mm, the operator attaches the abraded front top roller 20 to the spinning unit 2 and continues to produce the spun yarn 10 by the high speed spinning of a spinning speed of at least 400 m/min. If the step L1 of the front top roller 20 after the abrasion is smaller than 1.5 mm (if the fiber contacting portion 30 is worn out to the limit), the yarn quality degrades if such a front top roller 20 is used, and thus, the relevant front top roller 20 is discarded.

As described above, in the fine spinning machine 1 of the present embodiment, the spun yarn 10 is produced while repeating the use and abrasion of the front top roller 20. That is, the fine spinning machine 1 of the present embodiment is performing spinning while gradually changing the step L1 of the front top roller 20 from 2.5 mm to 1.5 mm. By manufacturing the spun yarn 10 with such a manufacturing method, the degradation in the yarn quality can be suppressed while abrading and reusing the front top roller 20.

Meanwhile, as disclosed in Patent Document 3, it is known that drawbacks arise if the step is greater than 1.5 mm in the high speed spinning in which the spinning speed is at least 300 m/min. Thus, conventionally, a roller having a step larger than 1.5 mm has not been used. In other words, from conventional common knowledge, the front top roller 20 of the present embodiment (a step of 2.5 mm) may be considered as an impractical draft roller.

The spinning speed of about 350 m/min was a limit in the high speed spinning when Patent Document 3 was filed. However, the spinning speed is further increasing in recent years, and the spinning speed of around 400 m/min has become popular, and thus the spinning speed of at least 400 m/min may be set. If the spinning speed increases, the rotation speed of the front top roller 20 also increases, and thus the accompanying airflow generated at the periphery of the front top roller 20 also changes. Therefore, the experimental result described in Patent Document 3 may not be applied to the fine spinning machine 1 of the present embodiment (spinning speed of at least 400 m/min).

Experiments have been conducted to compare the conventional front top roller (a step of 1.5 mm) and the front top roller 20 (a step of 2.5 mm) of the present embodiment in high speed spinning at about 400 m/min (spinning speed of at least 350 m/min). The conventional front top roller is, specifically, a roller in which the fiber contacting portion 30 has the outer diameter D1 of 30 mm, the width W of 18 mm, and the reduced-diameter portion 31 has the outer diameter D2 of 27 mm.

Contents of the experiments will be specifically described below. A plurality of spinning units 2 adopting the conventional front top roller (a step of 1.5 mm) and a plurality of spinning units 2 adopting the front top roller of the present embodiment (a step of 2.5 mm) are prepared. In each spinning unit 2, high speed spinning of around 400 m/min (spinning speed of at least 350 m/min) is carried out, and the number of yarn defects of the produced spun yarn 10 is measured. An average value of the number of yarn defects detected in the spun yarn 10 produced by the plurality of spinning units 2 is calculated, and such an average value becomes the measurement result. The measurement result is illustrated in FIG. 8 and FIG. 9. As the number of measured yarn defects is smaller, the spun yarn 10 has higher quality.

The measurement of the yarn defect can be carried out after the package 45 is formed, by measuring the spun yarn 10 wound into the package 45 with a dedicated measuring device (a yarn defect measuring device). The yarn defect of the spun yarn 10 can be measured in real time during the spinning with the yarn clearer 52 arranged in each spinning unit 2. In the experiments, data is acquired with both the yarn clearer 52 and the yarn defect measuring device, and thus both results are illustrated in graphs for reference. The yarn clearer 52 arranged in the spinning unit 2 of the present embodiment differs from the yarn defect measuring device in the measuring method of the spun yarn 10, and thus the measurement results differ. The measurement result by the yarn clearer 52 and the measurement result by the yarn defect measuring device match in overall tendency of the data, and thus explanation will not be separately made for each data in the present specification.

In FIG. 8 to FIG. 13, A1, B1, and C1 are names of category indicating types of yarn defects categorized by a known CLASSIMAT (registered trademark) test. The CLASSIMAT test continuously measures thickness unevenness of the yarn, and categorizes the yarn by a degree of thickness and length. For example, an A1 defect refers to the thickness unevenness in which the thickness falls within a range from the average (100%) to 150%, and the length is 1 cm at a maximum. A B1 defect refers to the thickness unevenness in which the thickness falls within a range from the average (100%) to 150%, and the length is from 1 cm to 2 cm. A C1 defect refers to the thickness unevenness in which the thickness falls within a range from the average (100%) to 150%, and the length is from 2 cm to 4 cm. The vertical axis of the graph of FIG. 8 to FIG. 13 indicates the detected number of the yarn defects of A1, B1, and C1.

Figure 8A:
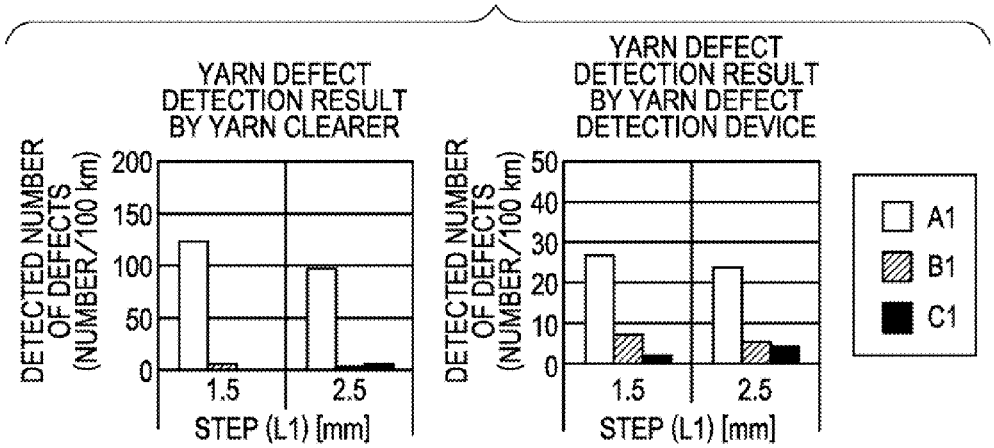
FIG. 8A is a graph illustrating yarn quality when a spun yarn of Rayon 100% and Ne30 is produced.
Figure 8B:
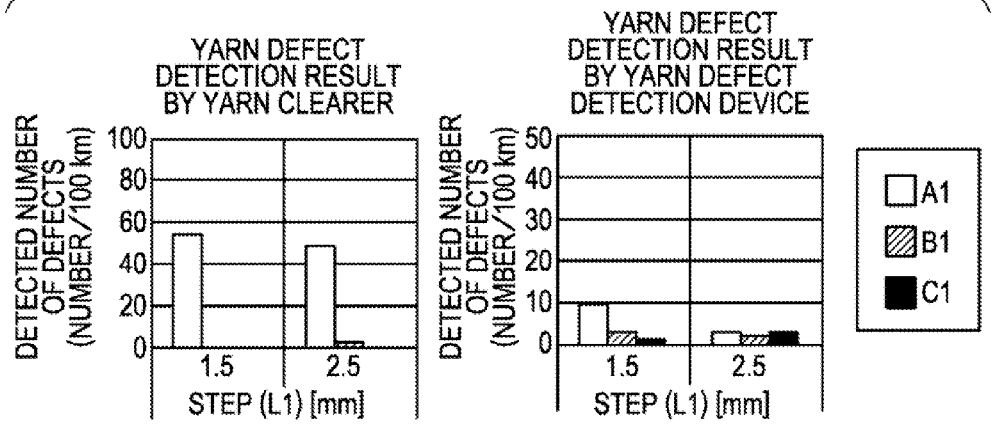
FIG. 8B is a graph illustrating yarn quality when a spun yarn of PE 100% and Ne30 is produced.
Figure 9A:
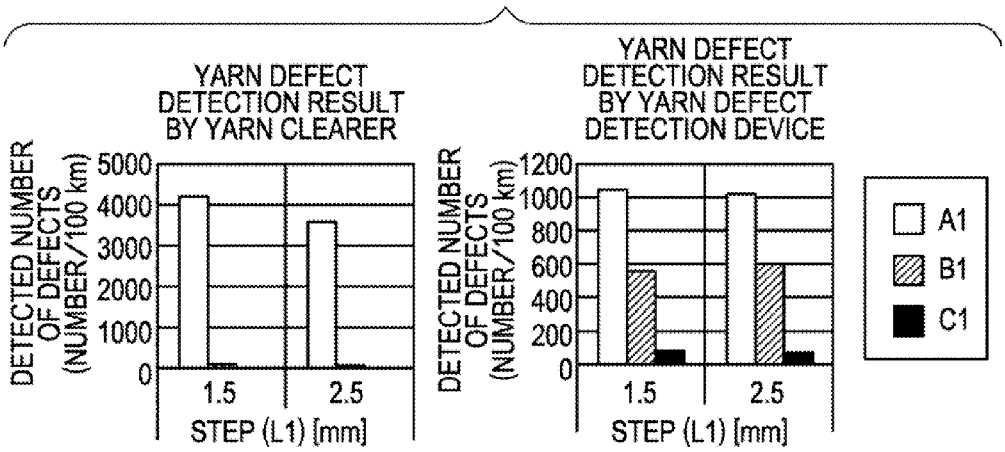
FIG. 9A is a graph illustrating yarn quality when a spun yarn of CD 100% and Ne30 is produced.
Figure 9B:
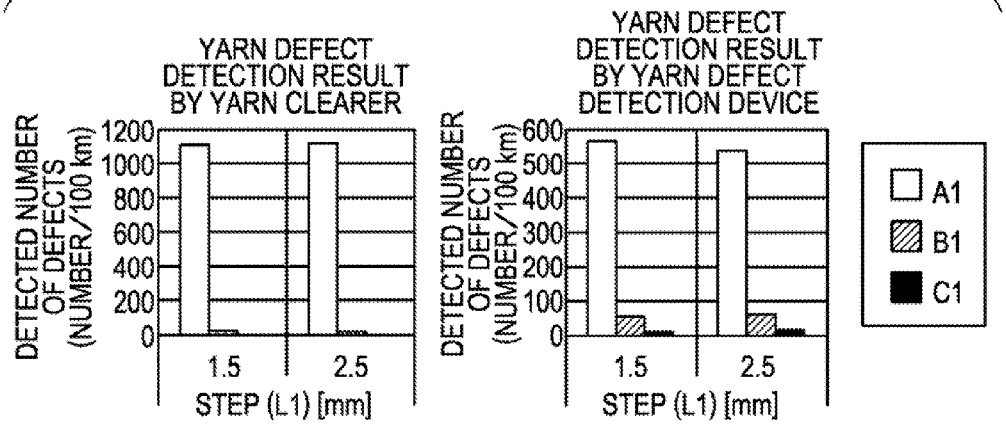
FIG. 9B is a graph illustrating yarn quality when a spun yarn of PC65/35 and Ne45 is produced.

In the experiments illustrated in FIG. 8 and FIG. 9, in order to verify a difference according to the type of fiber, experiments are conducted for each of a case where the spun yarn of a yarn count Ne30 is spun with the fibers of Rayon 100% (FIG. 8A), a case where the spun yarn of the yarn count Ne30 is spun with the fibers of polyester (PE) 100% (FIG. 8B), a case where the spun yarn of the yarn count Ne30 is spun with the fibers of card cotton (CD) 100% (FIG. 9A), and a case where the spun yarn of a yarn count Ne45 is spun with the fibers of polyester 65% and cotton 35% (PC65/35) (FIG. 9B).

As is apparent from FIG. 8 and FIG. 9, the quality of the spun yarn 10 produced using the front top roller 20 of the present embodiment (a step of 2.5 mm) is not inferior to the quality of the spun yarn 10 produced using the conventional front top roller (a step of 1.5 mm). That is, the spun yarn 10 produced using the front top roller 20 of the present embodiment has less number of yarn defects than the spun yarn 10 produced using the conventional front top roller. In other words, in the fine spinning machine 1 adopting the front top roller 20 of the present embodiment, the quality of the spun yarn 10 is improved.

Therefore, it became apparent for the first time from the experiments that the front top roller 20 having a step of 2.5 mm, which was conventionally considered as impractical, is actually effective at the spinning speed of around 400 m/min. In particular, the above effects can be obtained with the high speed spinning of at least 400 m/min, which is becoming popular in recent years. Therefore, the front top roller 20 of the present embodiment (a step of 2.5 mm) not only increases the number of times in which abrasion can be carried out and lengthening the life, but also improves the yarn quality.

The experiment results illustrated in FIG. 10 and FIG. 11 will be described below.

The above experimental results are the average values of the results of measuring the spun yarn 10 produced with the plurality of spinning units 2. However, even when the average yarn quality is satisfactory, if a spun yarn of unsatisfactory quality is produced in a specific spinning unit, only the yarn of unsatisfactory quality greatly stands out in a final fabric product. Therefore, in the fine spinning machine 1, it is important to not only improve the average quality of the produced spun yarn 10, but also to suppress the variation in quality among the plurality of spinning units 2.

Experiments have been conducted to examine the variation in the yarn quality among the plurality of spinning units 2. The results are illustrated in FIG. 10 and FIG. 11.

Figure 10A:
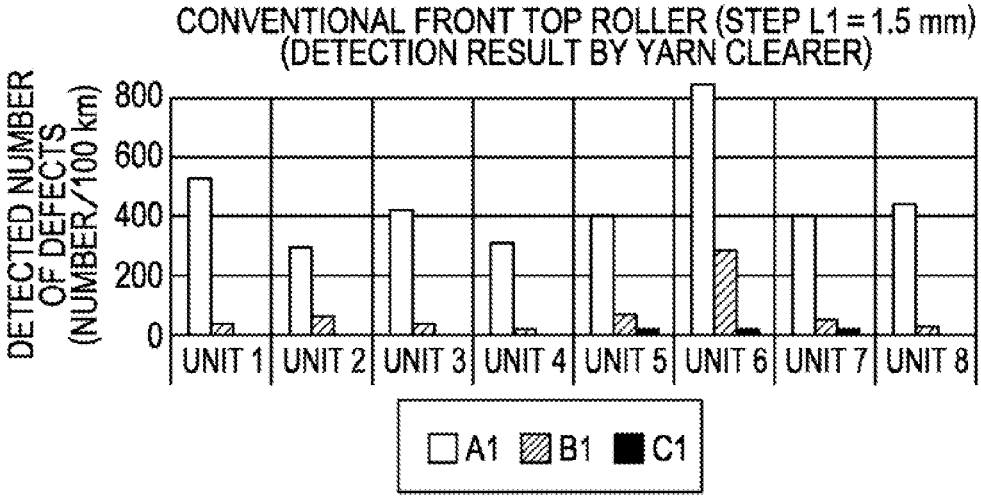
FIG. 10A is a graph illustrating yarn quality of each spinning unit when the conventional front top roller is used (detection result by a yarn clearer)
Figure 11A:
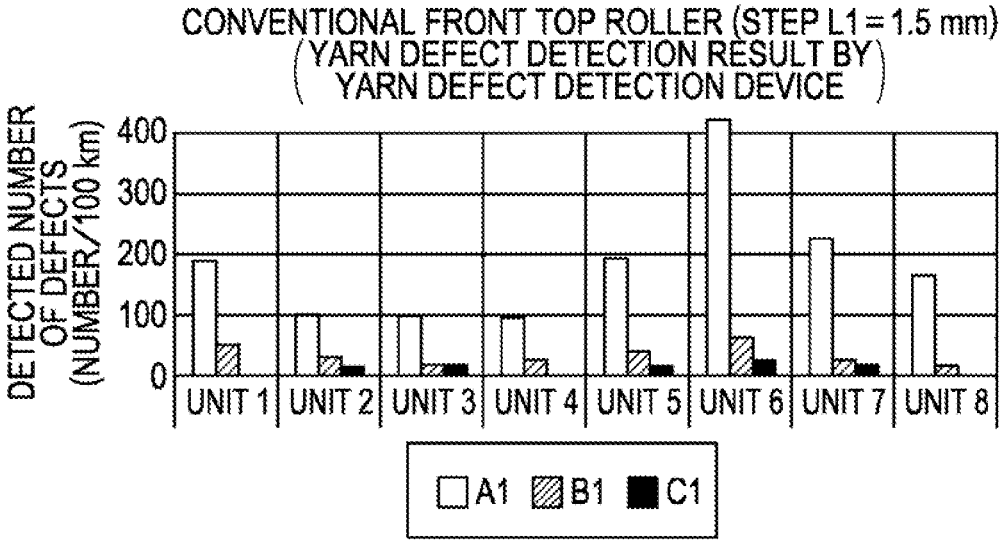
FIG. 11A is a graph illustrating yarn quality of each spinning unit when a conventional front top roller is used (detection result by a yarn defect detection device)

First, experiments on the conventional front top roller (a step of 1.5 mm) will be described. In the experiments, eight spinning units 2 adopting the conventional front top roller (a step of 1.5 mm) are prepared, and the spun yarn 10 of the yarn count Ne40 are produced with the fibers of Rayon 100% at the spinning speed of around 400 m/min in each spinning unit 2. FIG. 10A and FIG. 11A illustrate the number of yarn defects in the produced spun yarn 10 for every spinning unit 2.

As is apparent from the figures, when using the conventional front top roller having a step of 1.5 nm, the quality of the spun yarn 10 produced in each spinning unit 2 varies. For example, in the data of FIG. 10A, the spun yarn 10 produced in the spinning unit 2 indicated as "UNIT 6" has the most number of yarn defects (bad yarn quality).

At the conventional spinning speed (about 300 m/min), the yarn quality did not greatly vary among the plurality of spinning units 2. Therefore, problems rarely arose even with the conventional front top roller having a step of 1.5 mm. However, as the spinning speed becomes faster to the spinning speed of around 400 m/min in recent years, the yarn quality tends to easily vary among the plurality of spinning units 2, as illustrated in FIG. 10A and FIG. 11A. This is because since the rotation speed of the front top roller 20 becomes faster at high speed spinning, and the accompanying airflow is easily disturbed, the yarn quality is easily influenced by the slight individual difference or the like of each spinning unit 2.

The front top rollers of the eight spinning units 2, to which the experiments of FIG. 10A and FIG. 11A were conducted, were replaced with the front top roller 20 of the present embodiment (a step of 2.5 mm), and then conducted similar experiments. The results are illustrated in FIG. 10B and FIG. 11B.

Figure 10B:
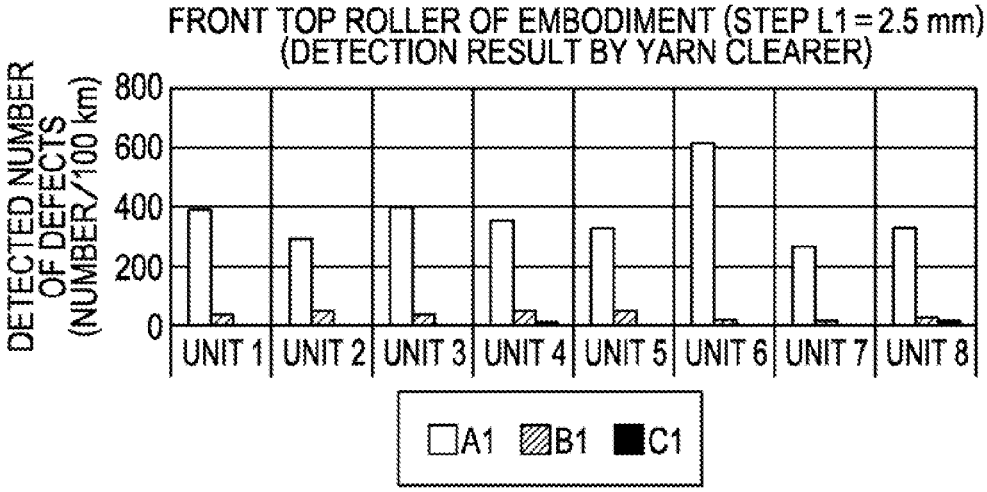
FIG. 10B is a graph illustrating yarn quality of each spinning unit when the front top roller of the embodiment is used (detection result by the yarn clearer)
Figure 11B:
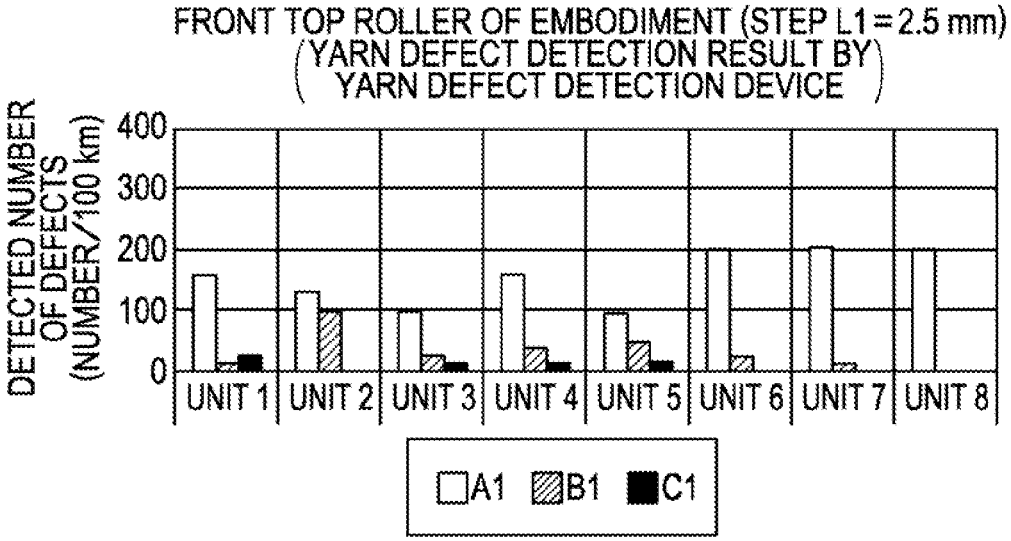
FIG. 11B is a graph illustrating yarn quality of each spinning unit when the front top roller of the embodiment is used (detection result by the yarn defect detection device)

As is apparent from FIG. 10B and FIG. 11B, when the front top roller 20 of the present embodiment (a step of 2.5 mm) is adopted, the variation in the yarn quality among the plurality of spinning units 2 is reduced as compared to a case where the conventional front top roller (a step of 1.5 mm) is adopted (FIG. 10A and FIG. 11A). If the front top roller 20 having a step of 2.5 mm is used, the gap for releasing the accompanying airflow can be sufficiently ensured between the relevant front top roller 20 and the front bottom roller 70, and the accompanying airflow is less likely to be disturbed. As a result, the influence of the individual difference of each spinning unit 2 hardly appears, and the variation in the yarn quality is assumed to be suppressed.

As described above, according to the front top roller 20 of the present embodiment, the variation in the yarn quality among the plurality of spinning units 2 that may occur at the spinning speed of around 400 m/min can be reduced. In particular, it was found that the above-described effects can be obtained in the high speed spinning of at least 400 m/min, which is becoming popular in recent years.

The experimental results of FIG. 12 and FIG. 13 will be described below.

The above experimental results are results of using the front top roller 20 of the initial shape. However, when the outer peripheral surface of the front top roller 20 is abraded as described above, the outer diameter D1 of the fiber contacting portion 30 is reduced and the step L1 becomes smaller, and hence the reduction of the step L1 is assumed to influence the yarn quality. Experiments were thus conducted to measure the influence on the yarn quality by reducing the outer diameter D1 of the fiber contacting portion 30 of the front top roller 20.

Specifically, for the conventional front top roller (the outer diameter D2 of the reduced-diameter portion is 27 mm) and the front top roller of the present embodiment (the outer diameter D2 of the reduced-diameter portion 31 is 25 mm), a plurality of front top rollers 20 in which the outer diameter D1 of the fiber contacting portion 30 is reduced by 0.3 mm from the initial shape (30 mm) are prepared. Specifically, the front top rollers of D1=30 mm, 29.7 mm, 29.4 mm, 29.1 mm, and 28.8 mm were prepared for each of the conventional front top roller (the outer diameter D2 of the reduced-diameter portion is 27 mm) and the front top roller of the present embodiment (the outer diameter D2 of the reduced-diameter portion is 25 mm). Then, each front top roller was set in the spinning unit 2, and the spun yarn 10 was produced at the spinning speed of around 400 m/min.

Figure 12A:
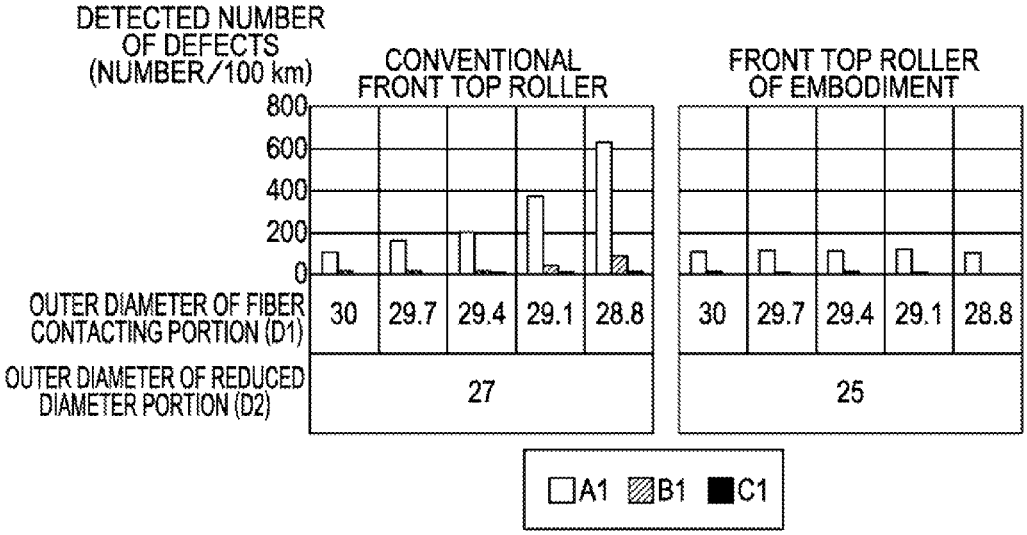
FIG. 12A is a graph illustrating a change in yarn quality when the spun yarn of Rayon 100% and Ne40 is produced while gradually reducing an outer diameter of the fiber contacting portion (detection result by the yarn clearer)
Figure 13A:
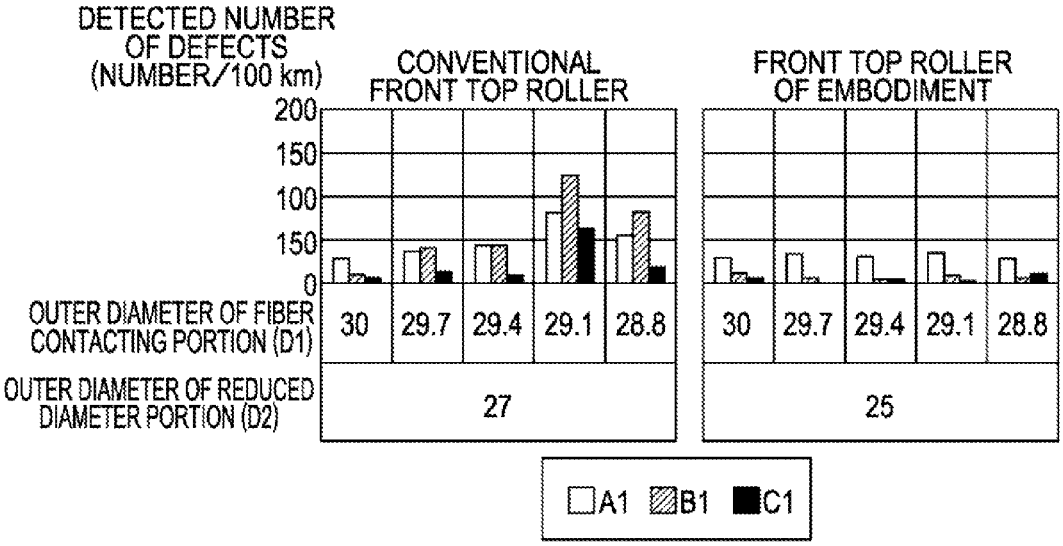
FIG. 13A is a graph illustrating a change in yarn quality when the spun yarn of Rayon 100% and Ne40 is produced while gradually reducing the outer diameter of the fiber contacting portion (detection result by the yarn defect detection device)

FIG. 12A and FIG. 13A illustrate the number of yarn defects in the spun yarn 10, where the spun yarn of the yarn count Ne40 was produced using each front top roller with the fibers of Rayon 100%. As illustrated in FIG. 12A and FIG. 13A, in the conventional front top roller (the outer diameter D2 of reduced-diameter portion is 27 mm), the number of yarn defects increases (the yarn quality degrades) as the outer diameter D1 of the fiber contacting portion becomes smaller from the initial shape (30 mm). This means that, in the conventional front top roller (a step of 1.5 mm in the initial shape), the yarn quality degrades as the outer peripheral surface of the fiber contacting portion is abraded.

In the front top roller 20 of the present embodiment (the outer diameter D2 of the reduced-diameter portion is 25 mm), although the outer diameter D1 of the fiber contacting portion 30 is reduced from the initial shape (30 mm), the number of yarn defects hardly increased. This means that in the front top roller 20 of the present embodiment (a step of 2.5 mm in the initial shape), even if the outer peripheral surface of the fiber contacting portion 30 is abraded, the yarn quality does not degrade as much as the conventional front top roller (a step of 1.5 mm in the initial shape).

In other words, since the step L1 of the front top roller 20 of the present embodiment is larger than the conventional front top roller (a step of 1.5 mm in the initial shape), even if the step L1 is reduced by abrasion, the influence on the yarn quality caused by the reduction in the step L1 is smaller than the conventional front top roller. Since the degradation in the yarn quality by the abrasion is small, the front top roller 20 of the present embodiment can be continuously used without any problems even after the abrasion. (However, as described above, the yarn quality degrades if the step L1 is smaller than 1.5 mm. Therefore, the front top roller 20 of the present embodiment can be used without any problems only if the step L1 after the abrasion is greater than or equal to 1.5 mm.)

Figure 12B:
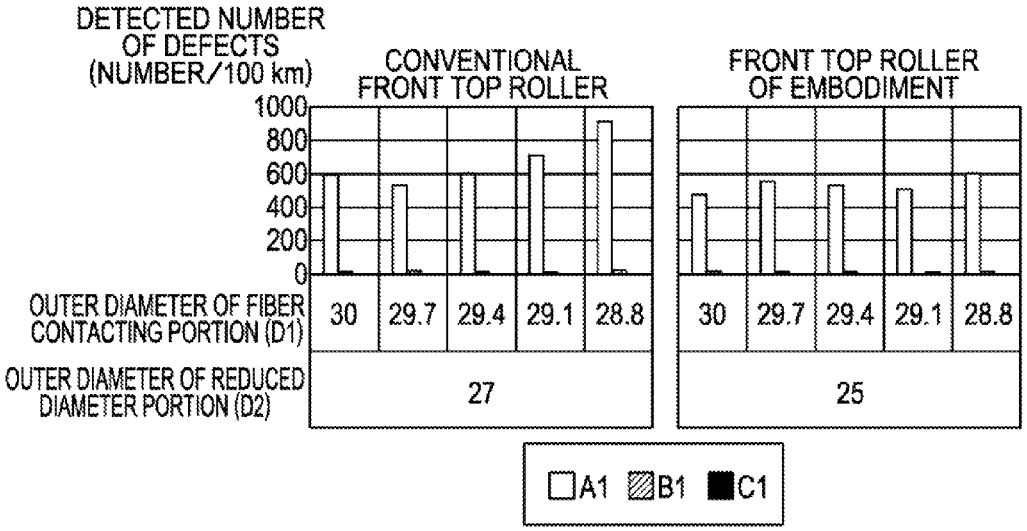
FIG. 12B is a graph illustrating a change in yarn quality when the spun yarn of combed cotton 100% and Ne30 is produced while gradually reducing the outer diameter of the fiber contacting portion (detection result by the yarn clearer)
Figure 13B:
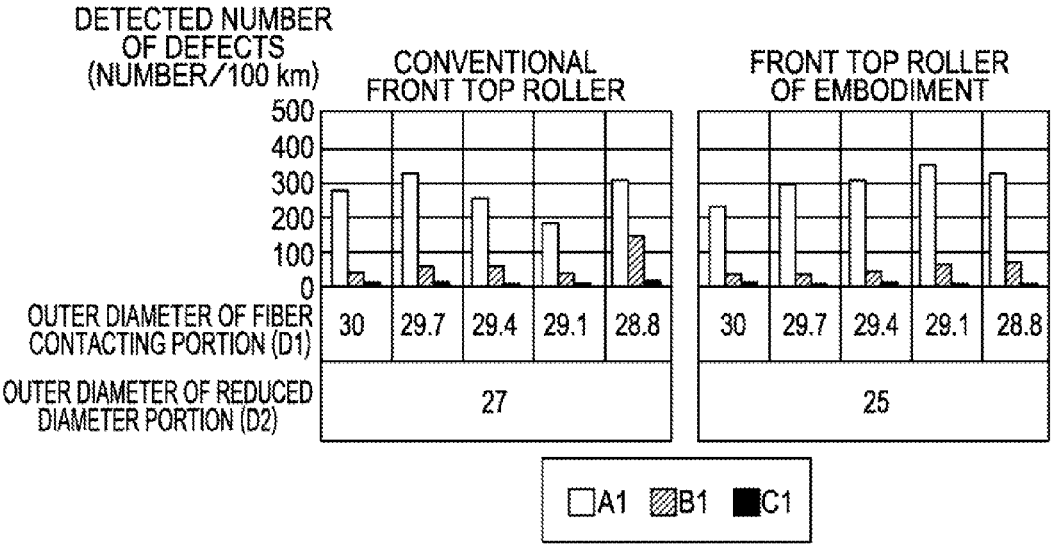
FIG. 13B is a graph illustrating a change in yarn quality when the spun yarn of combed cotton 100% and Ne30 is produced while gradually reducing the outer diameter of the fiber contacting portion (detection result by the yarn defect detection device).

FIG. 12B and FIG. 13B illustrate the results of producing the spun yarn 10 of the yarn count Ne30 with the fiber of combed cotton 100% under the same conditions as described above. As is apparent from FIG. 12B and FIG. 13B, in this case as well, even if the outer diameter D1 of the fiber contacting portion 30 is reduced from the initial shape (30 mm), the number of yarn defects hardly increased with the front top roller 20 of the present embodiment. In other words, even when producing the spun yarn 10 of cotton 100%, the front top roller 20 of the present embodiment can be used without any problems.

However, as is apparent from comparing FIG. 12A and FIG. 12B, the effect in improving the yarn quality through the use of the front top roller 20 of the present embodiment is greater in producing the spun yarn 10 of Rayon 100%. This is because the Rayon fibers are more flexible than the cotton fibers and are more easily subjected to the influence of the accompanying airflow, and hence the influence of the change in the shape of the front top roller 20 is large. Therefore, by using the front top roller 20 of the present embodiment when spinning flexible fibers such as Rayon, in particular, the effects of the present invention to reduce the degradation in the yarn quality by abrasion can be more effectively achieved.

As described above, the front top roller 20 of the present embodiment includes the fiber contacting portion 30 and the reduced-diameter portion 31. The fiber contacting portion 30 has a substantially uniform outer diameter. The reduced-diameter portion 31 is provided at both ends of the fiber contacting portion 30 in the axial direction, and is formed with the outer diameter smaller than that of the fiber contacting portion 30. The fiber contacting portion 30 has the width W1 in the axial direction of 18 mm, and the outer diameter D1 of 30 mm. The outer diameter D2 of the reduced-diameter portion 31 is 25 mm.

Since the step L1 formed by the fiber contacting portion 30 and the reduced-diameter portion 31 is 2.5 mm, the front top roller 20 has a margin in the step as compared to the conventional front top roller (a step of 1.5 mm). Therefore, even if the fiber contacting portion 30 is abraded and the step L1 becomes small, the influence on the yarn quality is smaller than the conventional front top roller. As a result, since the front top roller 20 of the present embodiment can be abraded more times than the conventional front top roller, the front top roller 20 can be used for a longer period of time, and the operation cost can be reduced. Furthermore, in the high speed spinning in which the spinning speed is around 400 m/min, the number of yarn defects can be reduced with the front top roller 20 having the step of 2.5 mm as compared to the conventional front top roller.

After the outer peripheral surface of the fiber contacting portion 30 is abraded, the front top roller 20 of the present embodiment has a step L1 of greater than or equal to 1.5 mm.

Since the step is made greater than the conventional front top roller, the front top roller 20 of the present embodiment can allow the abrasion of the fiber contacting portion 30 while the step is greater than at least the conventional front top roller (a step of 1.5 mm). If the fiber contacting portion 30 is excessively abraded, the thickness of the rubber of the fiber contacting portion 30 becomes thin and the gripping force of the fiber bundle 8 is lowered, which may become a cause of degradation in yarn quality. However, according to the above structure, the step of at least 1.5 mm can be ensured. That is, the space of at least 1.5 mm can be ensured for releasing the accompanying airflow even after the abrasion, and the degradation in yarn quality can be prevented.

In the front top roller 20 of the present embodiment, the fiber contacting portion 30 and the reduced-diameter portion 31 are connected by the taper portion 32.

Therefore, when abrading the cuter peripheral surface of the fiber contacting portion 30 with the abrasion device 50, the front top roller 20 can be allowed to be more easily moved towards the grinding stone 51 from the axial direction, and the abrasion operation can be smoothly carried out.

The spinning unit 2 of the present embodiment includes the draft device 7 adapted to draft the fiber bundle 8 and the spinning device 9 adapted to spin the fiber bundle 8 drafted by the draft device 7 at the spinning speed of at least 400 m/min. The draft device 7 includes the front top roller 20 adapted to draft the sliver 15 by rotating.

In the spinning unit 2 of the present embodiment, the draft device 7 includes a plurality of rollers for drafting the fiber bundle 8 in the transportation direction of the fiber bundle 8. The structure of the present invention is applied to the front top roller 20 arranged most downstream of the draft device 7.

In the draft device 7, the rotation speed becomes higher in the roller located downstream. Therefore, since the front top roller 20 arranged most downstream rotates at a very high speed, the influence of the accompanying airflow is large and the wear is also severe. The structure of the present invention is thus applied to such a front top roller 20, and the effects of increasing the number of times in which abrasion can be carried out and reducing the number of yarn defects can be more suitably achieved.

The fine spinning machine 1 of the present embodiment includes a plurality of spinning units 2.

In the fine spinning machine 1, the front top roller 20 of which the usable period is longer than the conventional front top roller is adopted in each spinning unit 2, and thus the operation cost of the entire fine spinning machine 1 can be reduced. Furthermore, in the high speed spinning of at least 400 m/min, by adopting the front top roller 20 having a step (a step of 2.5 mm) larger than the conventional front top roller in each spinning unit 2, the influence of the accompanying airflow is less likely to be received. As a result, the variation in the yarn quality for each spinning unit 2 can be reduced, and the quality of the produced spun yarn 10 can be maintained uniform.

In the fine spinning machine 1 of the present embodiment, the spun yarn 10 is manufactured with a method of carrying out spinning while gradually changing the step L1 from 2.5 mm to 1.5 mm.

If the outer peripheral surface of the fiber contacting portion 30 begins to be recessed by wear, the outer peripheral surface of the fiber contacting portion 30 is abraded to reduce the outer diameter. The outer peripheral surface of the fiber contacting portion 30 can be made in a smooth state and the front top roller 20 can be reused. Therefore, although the step on the outer peripheral surface of the front top roller 20 is gradually reduced through abrasion, the yarn quality can be prevented from degrading by having the step within the range described above.

The preferred embodiments of the present invention have been described above, but such a structure can be modified as below.

In the embodiments described above, the description has been made on the spinning unit 2 having a structure of pulling out the spun yarn 10 from the spinning device 9 by the rotating yarn accumulating roller 14. However, the structure is not limited thereto, and for example, the spun yarn 10 may be pulled out from the spinning device 9 by sandwiching the spun yarn 10 with two rollers arranged facing each other and rotating the rollers.

In the embodiments described above, the structure in which the step is provided on the front top roller 20 has been adopted, but the structure of the present invention may be applied to any one of the plurality of draft rollers arranged in the draft device 7. In particular, by applying the structure of the present invention to the draft rollers 16, 17, and 20, which outer peripheral surface is made of rubber, the effect of the present invention of preventing degradation in the yarn quality caused by abrasion of the outer peripheral surface can be suitably achieved.

The taper portion 32 may be omitted.

The invention claimed is:

1. A draft roller suitable for drafting a fiber bundle, the draft roller comprising:

a fiber contacting portion having a substantially uniform outer diameter, a width in an axial direction being 18 mm and the outer diameter being 30 mm, and a reduced-diameter portion provided at both ends of the fiber contacting portion in an axial direction, the reduced-diameter portion having an outer diameter of 25 mm.

2. The draft roller according to claim 1, wherein after abrading an outer peripheral surface of the fiber contacting portion, a step formed by the outer peripheral surface of the fiber contacting portion and an outer peripheral surface of the reduced-diameter portion is at least 1.5 mm.

3. A draft roller suitable for drafting a fiber bundle, the draft roller comprising:

a fiber contacting portion having a substantially uniform outer diameter, and a reduced-diameter portion provided at both ends of the fiber contacting portion, the reduced-diameter portion having an outer diameter smaller than the outer diameter of the fiber contacting portion to form a step of at least 1.5 mm by an outer peripheral surface of the fiber contacting portion and an outer peripheral surface of the reduced-diameter portion after abrasion of the outer peripheral surface of the fiber contacting portion; and wherein the outer diameter of the reduced-diameter portion is 25 mm, and the outer diameter of the fiber contacting portion before abrasion is 30 mm.

4. A spinning unit comprising:

a draft device adapted to draft a fiber bundle, and includes a draft roller adapted to draft the fiber bundle by rotating, the draft roller including a fiber contacting portion having a substantially uniform diameter, a reduced-diameter portion having an outer diameter smaller than an outer diameter of the fiber contacting portion, and a step of 2.5 mm formed by an outer peripheral surface of the fiber contacting portion and an outer peripheral surface of the reduced-diameter portion;

a spinning section adapted to spin the fiber bundle drafted by the draft device at a spinning speed of at least 400 m/min; and wherein the fiber contacting portion has a width in the axial direction of 18 mm and an outer diameter of 30 mm, and the reduced-diameter portion has an outer diameter of 25 mm.

5. The spinning unit according to claim 4, wherein the draft device includes a plurality of rollers adapted to draft the fiber bundle and arranged along a transportation direction of the fiber bundle, and the draft roller is a front top roller arranged most downstream in the transportation direction in the draft device.

6. A spinning machine comprising a plurality of spinning units according to claim 4.

* * * * *